United States Patent [19]

Mahler

[11] 4,205,921

[45] Jun. 3, 1980

[54] DEVICE FOR HOMOGENIZATION OF A PARTICLE FILLED FLUID STREAM

[76] Inventor: Arnold L. Mahler, Prins Bernhardlaan 48, Heelsum, Netherlands

[21] Appl. No.: 947,527

[22] Filed: Oct. 2, 1978

[51] Int. Cl.[2] ..... B01F 5/00

[52] U.S. Cl. ..... 366/338; 19/304; 162/343

[58] Field of Search ..... 162/343, 380; 264/121; 138/39, 42; 366/338, 336; 19/304

[56] References Cited

U.S. PATENT DOCUMENTS

| | | | |
|---|---|---|---|
| 3,206,170 | 9/1965 | Schippers et al. | 138/42 X |
| 3,239,197 | 3/1966 | Tollar | 138/42 X |
| 3,746,524 | 7/1973 | Kirchheim | 264/121 X |
| 3,846,229 | 11/1974 | Kallmes | 162/343 X |

*Primary Examiner*—Richard V. Fisher

*Attorney, Agent, or Firm*—Stevens, Davis, Miller & Mosher

[57] ABSTRACT

A device for homogenization of a particle filled fluid stream in which a conduit has a plurality of baffles which extend inwardly into the conduit so as to cross the fluid stream to be divided into smaller streams, preferably crossing over each other when being divided.

11 Claims, 7 Drawing Figures

DEVICE FOR HOMOGENIZATION OF A PARTICLE FILLED FLUID STREAM

The invention is related to a device for homogenization of a particle filled fluid stream, in particular a fluid stream charged with fibers.

A fiber web obtained with the common devices for lying non-woven random webs shows irregularities in its appearance. These irregularities can be distinguished in those which fluctuate in machine direction and those which fluctuate in cross direction. The first type of irregularities normally has a long wave frequency and depends mainly on the regularity of the feed introduced into a card. The second type of irregularities is usually characterized by sudden variations that occur close to each other and appears as heavy and light bands extending next to each other in the machine direction and mainly depends on the flock form of the material with which the card is fed and on the combing characteristics of the card.

The present invention has as an object the suppression of the second type of fluctuations by providing an as uniform as possible distribution of the fibers or other material over the cross section in a fluid stream and consequently has a similar effect in the case of fibers in the subsequently laid fiber web.

According to the invention this desired result is obtained with a device in which the outer wall of the fluid duct is gradually shaped into a rectangular form with a width that is desired at the delivery exit and is provided with at least one mixing station consisting of two types of inner baffles, that do not touch each other, and with supports therefor, of which the main dimensions extend essentially parallel to the main dimension of the rectangular outer wall in such a manner that the incoming rectangular fluid flow is divided into two essentially equal flow parts, each of which is urged to follow a path that causes it to reshape in cross section to two times its individual previous width and further is allowed to continue its path in a position situated partially under and partically over the other flow part.

By the device according to the invention a mixing action is performed on the particle loaded air flow over the whole width of it in such a manner that a more uniform distribution of the particles, in particular fibers, filaments or flocks, is obtained.

To refine the mixing it is preferred that there are several mixing stations in succession.

To increase the effect of several mixing stations in succession, it is preferred, that the successive mixing stations show a progressive subdivision of the rectangular fluid flow approaching the station in question into partial pairs of streams that are due to be forced to flow from a vertical neighboring position towards a horizontal neighboring position.

To obtain a simple device, it is contemplated that the progressive subdivisions be geometrical.

To fulfill the requirements, it is preferred that the rectangular cross sectional dimension of the duct be changed in size.

In certain circumstances it will be desired to change the linear speed of transport of the particles in the flow direction. To obtain this it is contemplated that the above indicated changes in size will predominantly relate to the height of the channel and be developed proportionally or exponentially with reference to the channel length.

To avoid local clogging or adherence of particles to the surfaces of the device, it is preferred that the material of which the device is constructed has a polished surface and rounded edges, which is, strictly needed in case of fiber filled fluids, and is a conductive material to neutralize electrostatic charges.

To disturb the fluid flow through the device as little as possible and to obtain the desired mixing effect as indicated above, it is preferred that the supports of the elements have a streamlined shape in the flow direction—the purpose of which is to cooperate by dynamic suction with the action of the neighboring baffle plate, to reshape the fluid column concerned.

It is remarked that the particles in the fluid stream comprise either short paper makers' fibers or textile staple fibers or continuous filaments or yarns or mixtures thereof. Said fiber, filament and/or yarn laden fluid stream finally is conducted to a device known per se for the formation of a non woven web.

It is remarked that the device according to the invention also may be used with a fiber-flock filled stream and/or with a fluid laden with non fibrous particles. It also is possible, that the device according to the invention cooperates with other flow regulating devices known to the art for use in the feed flow to the headboxes of single wire or of double wire paper machine systems.

In the accompanying drawing an example of the device according to the invention is schematically illustrated in which.

Figure 1:
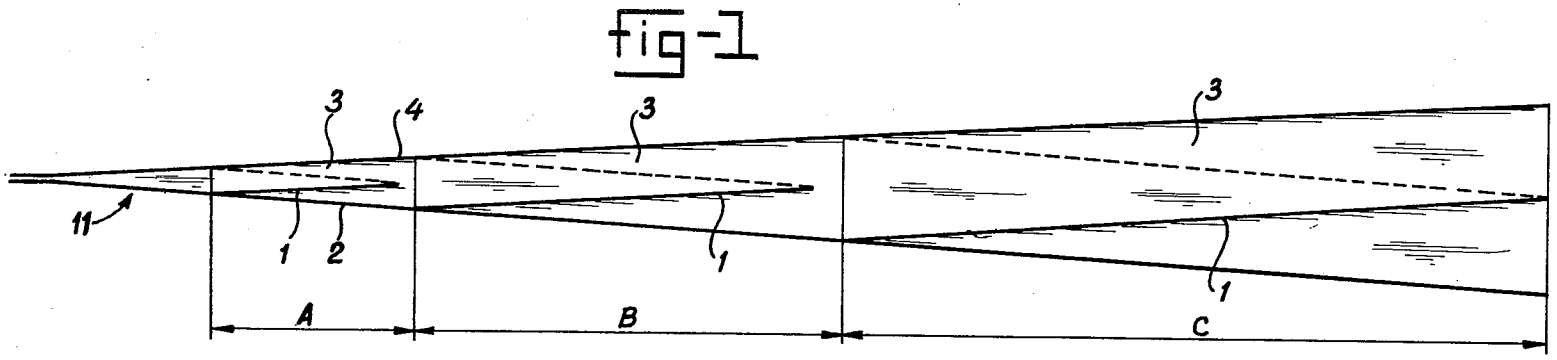
FIG. 1 shows the duct in longitudinal section.

The device will be described for a fiber filled fluid flow.

As indicated above the basic idea is that the fiber laden flow, which has a rectangular flat shape, is divided (vertically) into two parts at each "station", one of which is forced to flow "over" the other, while at the same time each of them is spread out in the cross direction. In this way the two flows, which originally moved next to each other as a single flow, are arranged into two flows which move over each other and unite again while maintaining the same total width as the original flow. Each part of the flow is extended widthwise to become a flow of half the height and twice the width of the original part.

Remodelling of the flow parts is effected by means of guiding baffles.

As can be seen from the drawing, the baffles are generally planar and project inwardly from a conduit wall at an acute angle. The supports for the baffles are generally "V" shaped in a direction parallel with the longitudinal axis of the conduit and the supports, along each leg of the "V", are tapered so as to completely fill the space between a baffle and the wall from which it projects. The upstream end of the conduit is of greater cross-sectional area than the downstream end, with the downstream end of greater height as shown in FIG. 1.

The same principle may be repeated several times (at every "station") further-on in the channel, as needed. In doing so, it will be possible to divide the two kinds of flow (which are going to be directed over each other)

into two partial flows. This is demonstrated in the drawing.

In FIG. 1 a lengthwise cross section of channel 11 is shown schematically. This channel 11 may correspond with the widening part 11 of duct 7 of the device described in the applicant's co-pending U.S. application Ser. No. 947,526, filed Oct. 2, 1978. The baffles 1 that are drawn in full lines are mounted upon the bottom 2 and the baffles 3 drawn in dotted lines hang from the cover plate 4. Note that the end edges 5 and 6 of the baffles do not touch each other.

Figure 2:
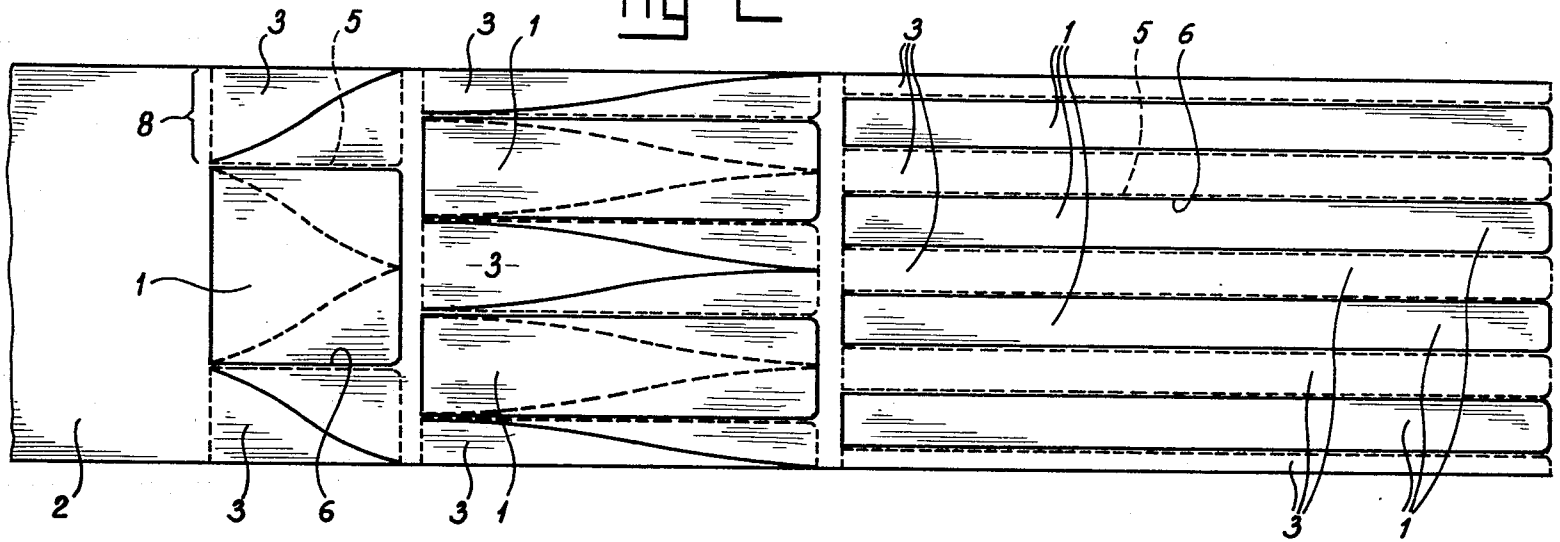
FIG. 2 shows a top view with the upper wall removed.

In the present example the baffles are subdivided locally in three progressively finer operating levelling "stations" A, B and C. In FIG. 2 it is shown how the width of the baffles changes in the succeeding stations. Here it can also be observed that the units at the side walls of the channel 11 are designed as half-size baffles. Apart from the constructive necessity this presents an evident advantage for the levelling cooperation of the succeeding stations.

Figure 3:
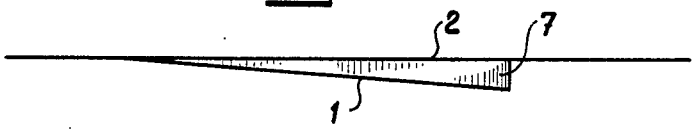
FIG. 3 and FIG. 4 show a side view of one baffle element in cross section and a top view of same respectively.
Figure 4:
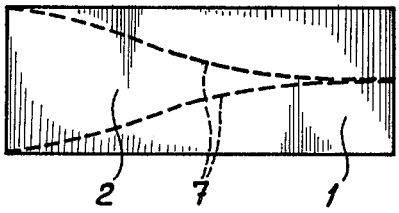
Figure 5:
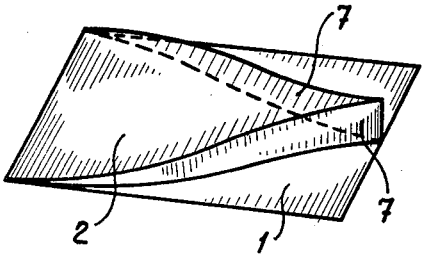
FIGS. 5–7 are in perspective views of single baffle elements.
Figure 6:
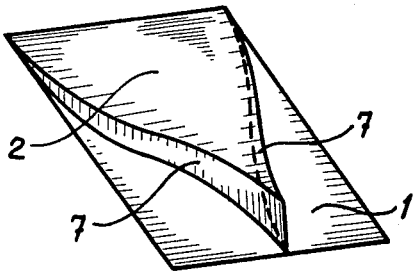
Figure 7:
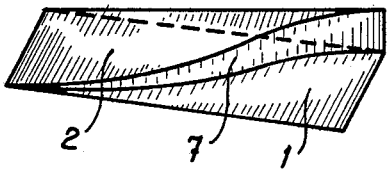

The baffles are only able to operate adequately and at the same time be mounted firmly when they are supported by stream-lined shaped parts which are placed between the baffles and the wall from which they project. This is shown in the following manner in FIGS. 3–7:

FIG. 3 is a cross section, looking sideways: baffle 1 stands away from wall 2 and is supported by part 7. FIG. 4 is a top view of the baffle of FIG. 3. FIG. 5 and FIG. 6 show this same baffle in perspective. In FIG. 7 a side wall bordering half element 8 is shown with baffle 1 and streamline support 7.

These supports have an essential effect with respect to the conduction of the air. They generate a slight local depression in the air flow—which is levelled out by the air that flows over the neighboring baffles. It is mainly by virtue of this that the width-wise flattening-out and evenly spreading action is realized.

It is self-evident that the whole flow channel be highly polished and that at least the baffles, the supports and the bottom and top plates should be constructed of metal (in view of static electricity and stiffness).

Generally speaking it will be clear that such an equalizing system by means of baffles is not only useful for a fiber web forming machine, but also for other systems where a particle laden fluid should be levelled and mixed-up in a broad channel.

I claim:

1. A device for homogenization of a flowing mass charged with particles comprising:

a conduit of quadrangular cross section having an upstream end and a downstream end;

at least one mixing station within the conduit to divide and recombine said flowing mass;

said mixing station having two inner baffles that do not touch each other, the baffles projecting inwardly from the conduit wall at an acute angle, supports for said baffles which extend essentially parallel to the longitudinal axis of said conduit;

said baffles and supports being positioned within said conduit to divide the flowing mass into two essentially equal flow parts, each being urged to follow a path to reshape it to a cross section about twice its individual previous width and in a path respectively over or under the other flow part.

2. The device of claim 1 in which the baffles are generally planar.

3. The device of claim 2 in which the supports for said baffles are generally "V" shaped in a direction parallel with the longitudinal axis of the conduit.

4. The device of claim 3 in which the supports, along each leg of the "V", are tapered so as to completely fill the space between a baffle and the wall from which it projects.

5. The device of claim 3 in which there are several mixing stations in succession.

6. The device of claim 5 in which the successive mixing stations progressively subdivide the flowing mass into partial pairs of streams with the next succeeding station positioned to move the flow from a horizontal to a vertical orientation.

7. The device of claim 6 in which the progressive subdivision is geometrical.

8. The device of claim 1 in which the upstream end of the conduit is of greater cross-sectional area than the downstream end.

9. The device of claim 8 in which the downstream end is of greater height.

10. The device of claim 1 in which the device is constructed of material having a polished surface and rounded edges and is electrically conductive.

11. The device of claim 1 in which the supports have a streamlined shape in the flow direction.

* * * * *